US005764256A

United States Patent [19]

Zhang

[11] Patent Number: 5,764,256

[45] Date of Patent: Jun. 9, 1998

[54] SYSTEM AND METHOD FOR EJECTING INK DROPLETS FROM A NOZZLE

[75] Inventor: Qiming Zhang, Westford, Mass.

[73] Assignee: Brother Kogyo Kabushiki Kaisha, Nagoya, Japan

[21] Appl. No.: 393,391

[22] Filed: Feb. 23, 1995

[30] Foreign Application Priority Data

Mar. 3, 1994 [JP] Japan ..... 6-033456
Mar. 3, 1994 [JP] Japan ..... 6-033457

[51] Int. Cl.[6] ..... B41J 2/045

[52] U.S. Cl. ..... 347/71; 347/10

[58] Field of Search ..... 347/10, 15, 11, 347/68–72

[56] References Cited

U.S. PATENT DOCUMENTS

| | | | |
|---|---|---|---|
| 3,946,398 | 3/1976 | Kyser et al. | 347/70 |
| 4,513,299 | 4/1985 | Lee et al. | 347/15 |
| 4,686,539 | 8/1987 | Schmidle et al. | 347/15 |
| 4,723,129 | 2/1988 | Endo et al. | 347/56 |
| 4,743,924 | 5/1988 | Scardovi | 347/10 |
| 4,887,100 | 12/1989 | Michaelis et al. | 347/69 |
| 4,897,665 | 1/1990 | Aoki | 347/10 |

FOREIGN PATENT DOCUMENTS 60-157875 8/1985 Japan .

*Primary Examiner*—Benjamin R. Fuller
*Assistant Examiner*—Charlene Dickens
*Attorney, Agent, or Firm*—Oliff & Berridge, PLC

[57] ABSTRACT

Ink ejection device including a polarized piezoelectric element having a natural shape and forming at least a portion of a wall of an ink chamber, the ink chamber having a length and a natural volume and being connected with the nozzle and filled with ink; an electrode formed on the piezoelectric element; and an LSI chip applying voltage to the electrode to deform the piezoelectric element so that volume of the ink chamber increases, whereupon a pressure wave that propagates through the ink at a velocity of one length of the ink chamber in a time interval is generated in the ink, and, upon completion of a predetermined duration of time defined as approximately the time interval multiplied by an odd number equal to or greater than three, stopping application of voltage to the electrode to return piezoelectric element to the natural shape.

24 Claims, 12 Drawing Sheets

FIG. 6(a) t=t0=0
PRIOR ART
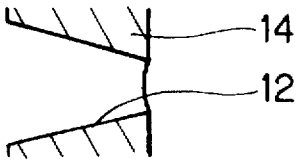
FIG. 6(b) t=t1=L/a
PRIOR ART
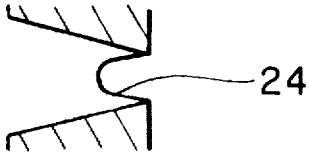
FIG. 6(c) t=t2=2L/a
PRIOR ART
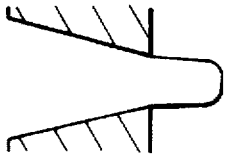
FIG. 6(d) t=t3=3L/a
PRIOR ART
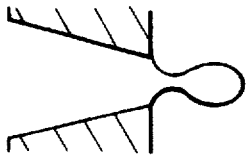
FIG. 6(e) t=t4=4L/a
PRIOR ART
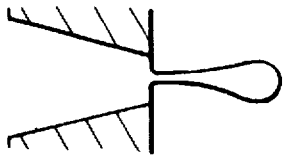
FIG. 6(f) t=t5=5L/a
PRIOR ART
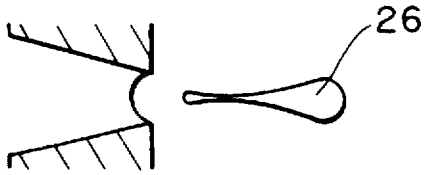
FIG. 6(g) t=t6=6L/a
PRIOR ART
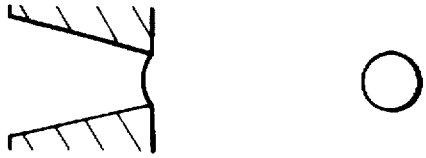

FIG. 10(a) t=t0=0
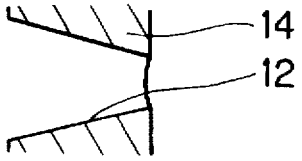
FIG. 10(b) t=t1=L/a
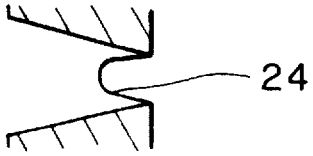
FIG. 10(c) t=t2=2L/a
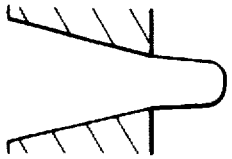
FIG. 10(d) t=t3=3L/a
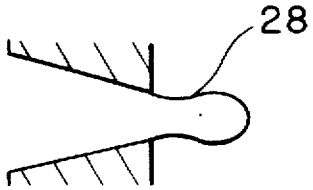
FIG. 10(e) t=t4=4L/a
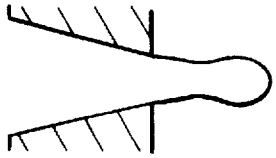
FIG. 10(f) t=t5=5L/a
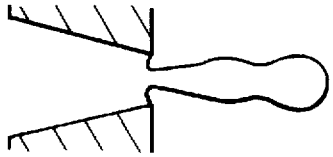
FIG. 10(g) t=t6=6L/a
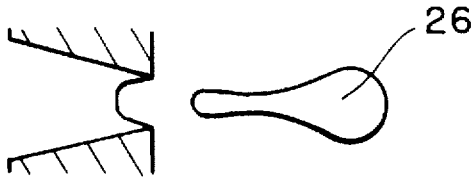
FIG. 10(h) t=t7=7L/a
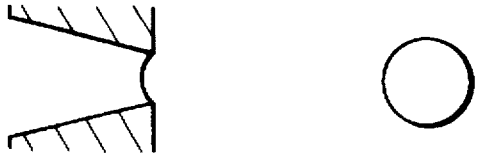

SYSTEM AND METHOD FOR EJECTING INK DROPLETS FROM A NOZZLE

BACKGROUND OF THE INVENTION

1. Field of the Invention

The present invention relates to an ink ejection device and a method for driving the ink ejection device.

2. Description of the Related Art

Non-impact type printers have largely replaced impact type printers on today's printer market and their share of the market is increasing. Ink jet printers are one type of non-impact printer. Ink jet printers are based on a simple theory and can be easily produced for printing tonal images and color images. Drop-on-demand ink jet printers eject ink only during printing so that ink is not wasted. This effective use of ink in combination with low running costs have rapidly brought drop-on-demand ink jet printers into popular use.

Two representative drop-on-demand printers are the Kaiser type described in U.S. Pat. No. 3,946,398 and the thermal jet type described in U.S. Pat. No. 4,723,129. However, the Kaiser type is difficult to make in a compact size. The ink to be ejected from the thermal jet type is subjected to high temperatures, which places restrictions on the variety of inks that can be used in the printer.

U.S. Pat. No. 4,887,100 describes a shear mode printer that overcomes the problems associated with the Kaiser and thermal jet type printers. As shown in FIG. 1, the shear-mode ink ejection device used in a printer includes a piezoelectric ceramic plate 2, a cover plate 10, a nozzle plate 14, and a substrate 41.

A plurality of grooves 3 are cut into the piezoelectric ceramic plate 2 using, for example, a diamond blade. Partition walls 6, which form the sides of each groove 3, are polarized in the direction indicated by arrow 5. The grooves 3 are formed to equal depth and in parallel with each other.

The depth of each groove 3 gradually decreases with increasing proximity to the back end 15 of the piezoelectric ceramic plate 2. Shallow grooves 7 are formed adjacent to the end 15. Metal electrodes 8 are formed to the upper half of both side surfaces of each groove 3 by sputtering or other technique. Metal electrodes 9 are formed to the floor and side surfaces of the shallow grooves 7 by sputtering or other technique. Therefore, the metal electrodes 8 formed to either side of a groove 3 are brought into electrical connection by the metal electrodes 9 formed to the floor and the side surfaces of the shallow grooves 7.

The cover plate 10 is made from a material such as a ceramic or resin material. An ink introduction port 16 and a manifold 18 are cut into the cover plate 10. The surface of the piezoelectric ceramic plate 2 with the grooves 3 formed therein is adhered by an epoxy adhesive 20 (refer to FIG. 3(*a*)) to the side of the cover plate 10 with the manifold 18 formed therein. By covering the upper open end of the grooves 3 in this way, a plurality of ink chambers 4 are formed, as shown in FIG. 3(*a*), that are aligned at an equidistant pitch in the widthwise direction. All of the ink chambers 4 are filled with ink.

As shown in FIG. 1, the nozzle plate 14 is adhered to the end of the piezoelectric ceramic plate 2 and the cover plate 10. Nozzles 12 are formed in the nozzle plate 14 at positions thereof corresponding to the positions of the ink chambers 4. The nozzle plate 14 is formed from a plastic material such as polyalkylene (for example ethylene), terephthalate, polyimide, polyether imide, polyether ketone, polyether sulfone, polycarbonate, or cellulose acetate.

The substrate 41 is adhered by an epoxy adhesive to the surface of the piezoelectric ceramic plate 2 opposite the side with the grooves 3 formed therein. Conductive layer patterns 42 are formed in the substrate 41 at positions thereof corresponding to positions of the ink chambers 4. Conductor wires 43 are provided for connecting the conductive layer patterns 42 to the metal electrodes 9 of the shallow grooves 7. As shown in FIG. 2, the other ends of the conductive layer patterns 42 are connected to an LSI chip 51 by wires. A clock line 52 for consecutively supplying a clock pulse, a data line 53 for supplying data on ink ejections, a voltage line 54, and an earth line 55 are also connected to the LSI chip 51.

Next, an explanation of the operation of the ink jet print head 1 will be provided while referring to FIGS. 3(*a*) and 3(*b*). Based on the clock pulse from the clock line 52 and data incoming over the data line 53, the LSI chip 51 determines from which ink chambers 4 ink is to be ejected (ink chamber 4*c* in this example). The LSI chip 51 applies a positive voltage V from the voltage line 52 to the metal electrodes 8*d* and 8*e* of the ink chamber 4*c*. On the other hand, the LSI chip 51 applies a ground voltage 0V from the ground line 55 to the metal electrodes 8*c* and 8*f* and to the metal electrodes of all ink chambers 4 from which ink is not to be ejected via the corresponding conductive layer patterns 42 and wires 43.

As shown in FIG. 3(*b*), an electric field is generated in the side wall 6*b* in the direction indicated by arrow 13*b* and an electric field is generated in the side wall 6*c* in the direction indicated by arrow 13*c*. Because the electric field directions 13*b* and 13*c* are at right angles to the polarization direction 5, the side walls 6*b* and 6*c* rapidly deform toward the interior of the ink chamber 4*c* by the piezoelectric thickness shear effect. The volume of the ink chamber 4*c* decreases as a result, and pressure rapidly increases so that an ink droplet with a predetermined volume is ejected at a predetermined speed from the nozzle 12 connected to the ink chamber 4*c*.

When application of the drive voltage V is stopped, the partition walls 6*b* and 6*c* return to their initial shape shown in FIG. 3(*a*). Therefore, the ink pressure in the ink chamber 4*c* gradually decreases. As a result, ink is supplied from an ink tank (not shown) to the ink chamber 4*c* by passing through the ink introduction port 16 and the manifold 18.

There has been known an ink ejection device wherein, as shown in FIGS. 4(*a*) and 4(*b*), the partition walls 6 are polarized in direction 71, which is the opposite direction from the polarization direction 5. By application of a positive voltage, partition walls 6*b* and 6*c* deform so as to move apart as shown in FIG. 4(*b*). By stopping application of the voltage, the partition walls 6*b* and 6*c* return to the initial shape they were in before they deformed so that ink is ejected from the ink chamber 4*c*.

SUMMARY OF THE INVENTION

A drive method for improving efficiency of ink ejection from the ink ejection device shown in FIGS. 4(*a*) and 4(*b*) and the behavior of the pressure wave generated in the ink chambers 4 by using this drive method will be explained while referring to the time chart in FIG. 5 and the cross-sectional diagrams of the ink ejection device shown in FIGS. 6(*a*) through 6(*g*).

In order to eject ink from the ink chamber 4*c* shown in FIG. 4(*b*), voltage is applied to the ink chamber 4*c* in a voltage pulse C that has a waveform as shown in the upper half of FIG. 5. (Hereinafter, application of voltage to an ink chamber will refer to application of a voltage to opposing metal electrodes in the ink chamber.) In response to the rising edge of the voltage pulse, the partition walls 6b and 6c deform so as to separate apart from each other as shown in FIG. 4(*b*). The volume of the ink chamber 4c increases, resulting in a decrease in the pressure in the ink chamber 4c, including near the nozzle 12. The pressure near the nozzle 12 in ink chamber 4c decreases as shown in the lower half of FIG. 5. This negative pressure is maintained near the nozzle 12 exactly for a time interval L/a, during which time ink is supplied from the manifold 18 (refer to FIG. 1) and the meniscus 24 retracts toward the interior the ink chamber 4c as shown in FIG. 6(*b*). Time interval L/a is the duration of time necessary for a pressure wave to propagate across the lengthwise direction of the ink chamber 4c (i.e., from the manifold 18 to the nozzle plate 14 or vice versa) wherein L is the length of the ink chamber 4c and a is the speed of sound through the ink filling chamber 4c.

Theories on pressure wave propagation teach that at the moment a time interval L/a elapses after the rising edge of voltage, the pressure near the nozzle 12 inverts to a positive pressure. A zero voltage is applied to the ink chamber 4c that matches this timing so that the partition walls 6b and 6c revert to their initial predeformation shape shown in FIG. 4(*a*). The pressure generated when the partition walls 6b and 6c return to their initial shape is added to the inverted positive pressure so that a relatively high pressure is generated in the ink chamber 4c near the nozzle 12. This relatively high pressure ejects an ink droplet from the nozzle 12 as shown in FIGS. 6(*c*) through 6(*g*). After the droplet is ejected, residual pressure fluctuations that remain in the ink chamber 4c, including pressure Pr near the nozzle 12, gradually attenuate with passage of time.

In the above-described drive method, the lowering edge of the drive pulse is set to coincide with the end of a time interval L/a after the rising edge of the drive waveform C as shown in FIG. 5. As described above, the positive pressure of the pressure wave in the ink chamber near the nozzle at this time is added to the pressure generated when the volume in the ink chamber decreases. However, at the point in time t1, when the resultant relatively high pressure Pc is applied to the ink in the ink chamber near the nozzle, the meniscus 24 is still retracted into the ink chamber as shown in FIG. 6(*b*). Therefore, a portion of the pressure Pc is consumed in pushing the meniscus 24 toward the aperture of the nozzle to return the meniscus to the shape shown in FIG. 6(*a*). This wasted portion of the pressure Pc does not contribute to ejection of the ink droplet. The remaining pressure may be insufficient to eject a sufficiently large ink droplet, thereby resulting in poor print quality.

Japanese Patent Application No. SHO-60-157875 describes a technique for printing two different tones of characters. The upper half of FIG. 7 shows waveforms representing timing at which pulses of voltage (multiple pulses) are applied for producing this effect. The lower half of FIG. 7 shows waveforms representing the resultant pressure changes in the ink chamber near the nozzle when the multiple pulse drive voltages are applied. After application of a first ejection pulse C of voltage is stopped, but before the thereby ejected ink separates from the ink in the ink chamber, a second ejection pulse M is applied for ejecting another ink droplet from the same nozzle. Because the ink that comprises the two ink droplets (i.e., one ejected by the drive pulse C and one ejected by the drive pulse M) is connected, the two droplets are pulled together into a single large ink droplet (not shown) by their surface tension. Characters printed with such large droplets have a higher inner density (darker tone). This drive method allows printing of characters selectively in one of two different densities (tones), depending on whether the second ejection pulse M is applied or not during printing operations.

A plurality of pulses are applied for ejecting a single droplet using this multiple pulse drive method for controlling the volume of ejected ink droplets. Because multiple applications of voltage consumes a great deal of power, the drive circuit heats up, which can result in damage to the control circuit. To solve this potential problem the drive circuitry must made from highly heat resistant materials. Another measure is to provide a heat radiating structure such as heat fins to reduce the heat at the circuit. However, both of these measures increase the cost of the drive circuit. Also, because the wall 6 is repeatedly deformed by application of the multiple pulses, the life of the ink ejection device is shortened because of mechanical wear to the walls 6.

It is an objective of the present invention to overcome the above-described problems and provide an ink ejection device that is capable of ejecting ink droplets with sufficient volume for good quality printing.

It is another objective of the present invention to provide an ink ejection device that is capable of tonal printing by controlling volume of ejected droplets, but that uses a simpler drive waveform, that uses less expensive drive circuitry, that consumes less power, and that has a longer life than multiple pulse ink ejection devices.

To solve the above-described problems, an ink ejection device according to one aspect of the present invention includes an ink chamber wall forming an ink chamber and a nozzle, the ink chamber having a length and a natural volume, the ink chamber being filled with ink; ink chamber volume changing means for increasing volume of the ink chamber from the natural volume to an increased volume, thereby generating in the ink a pressure wave that propagates through the ink at a velocity of one length of the ink chamber in a time interval, and for decreasing volume of the ink chamber from the increased volume; and control means for controlling the ink chamber volume changing means to increase volume of the ink chamber and, upon completion of a predetermined duration of time defined as approximately the time interval multiplied by an odd number equal to or greater than three, to decrease volume of the ink chamber.

In an ink ejection device according to another aspect of the present invention the control means is further capable of controlling the ink chamber volume changing means to decrease volume of the ink chamber upon completion of a different predetermined duration of time after the ink chamber volume changing means increases the volume of the chamber, the different predetermined duration of time being defined as approximately the time interval multiplied by a different odd number. Printing is therefore possible in either of two different tones by applying drive pulses at either of the two different durations of time.

BRIEF DESCRIPTION OF THE DRAWINGS

The above and other objects, features and advantages of the invention will become more apparent from reading the following description of the preferred embodiment taken in connection with the accompanying drawings in which:

FIG. 3(*b*) is a cross-sectional view showing operation for ejecting ink from an ink chamber of the ink ejection device shown in FIG. 1;

FIG. 4(*b*) is a cross-sectional view showing operation of the ink ejection device shown in FIG. 4(*a*);

FIGS. 6(*a*) through 6(*g*) are cross-sectional views showing changes in ink at the nozzle resulting from the pressure changes shown in FIG. 5;

FIGS. 10(*a*) through 10(*h*) are cross-sectional views showing changes in ink at the nozzle resulting from the pressure changes shown in FIG. 9;

DETAILED DESCRIPTION OF THE PREFERRED EMBODIMENT

Figure 1:
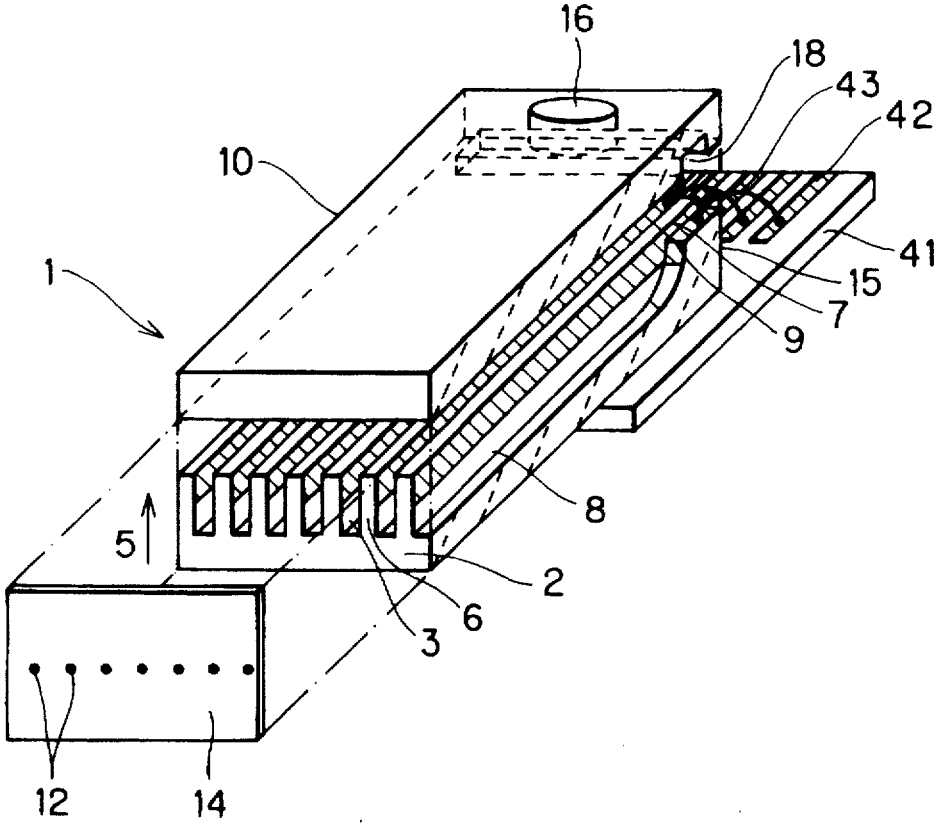
FIG. 1 PRIOR ART
FIG. 1 is a perspective view showing a conventional ink ejection device.
Figure 2:
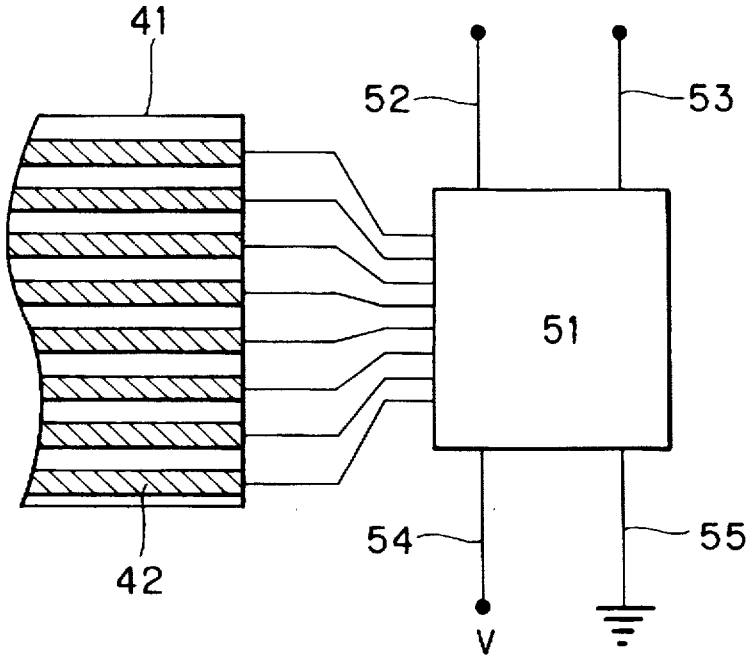
FIG. 2 PRIOR ART
FIG. 2 is a block diagram showing connections of an LSI for use with the ink ejection device shown in FIG. 1.
Figure 3A:
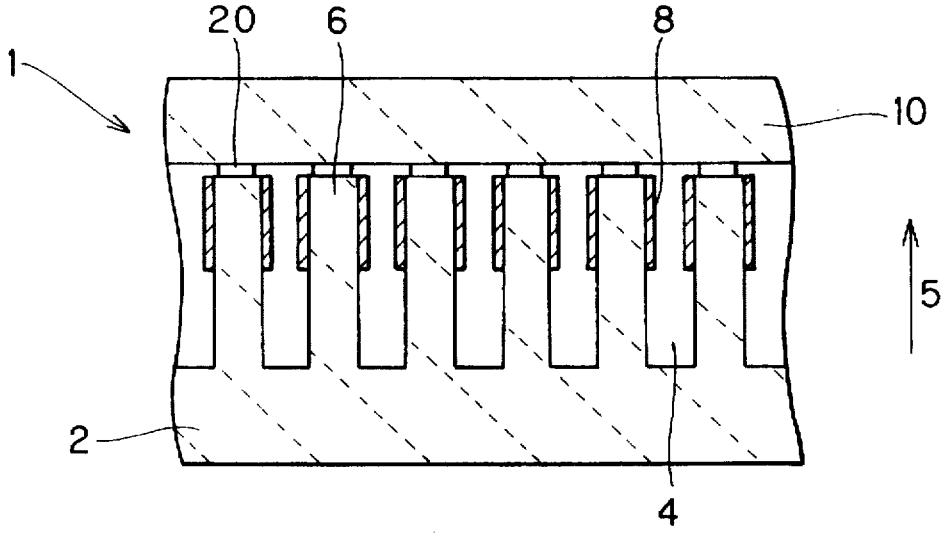
FIG. 3(a) PRIOR ART
FIG. 3(*a*) is a cross-sectional view showing the ink ejection device shown in FIG. 1.
Figure 3B:
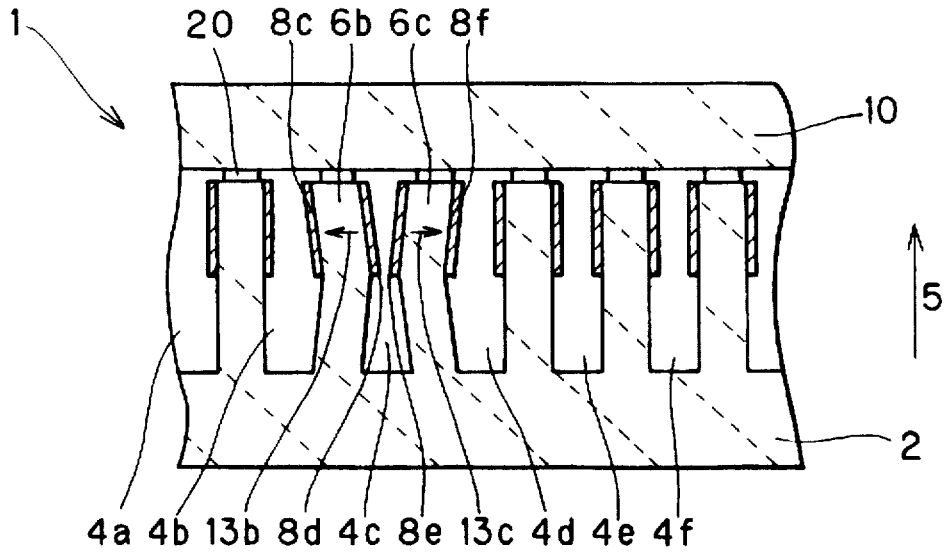
FIG. 3(b) PRIOR ART

An ink ejection device and control method according to a preferred embodiment of the present invention will be described while referring to the accompanying drawings wherein like parts and components are designated by the same reference numerals to avoid duplicating description.

Figure 4A:
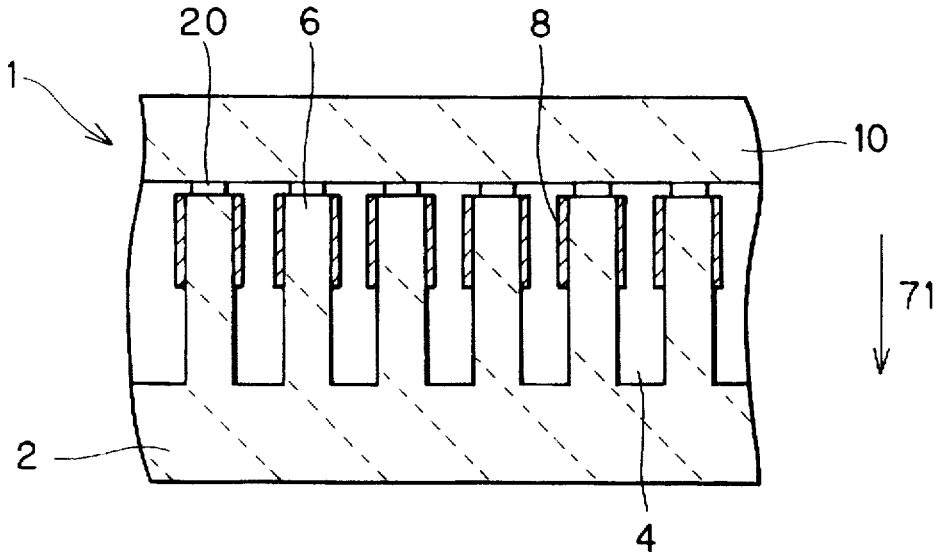
FIG. 4(a) PRIOR ART
FIG. 4(*a*) is a cross-sectional view showing a modification of the ink ejection device shown in FIG. 1.
Figure 4B:
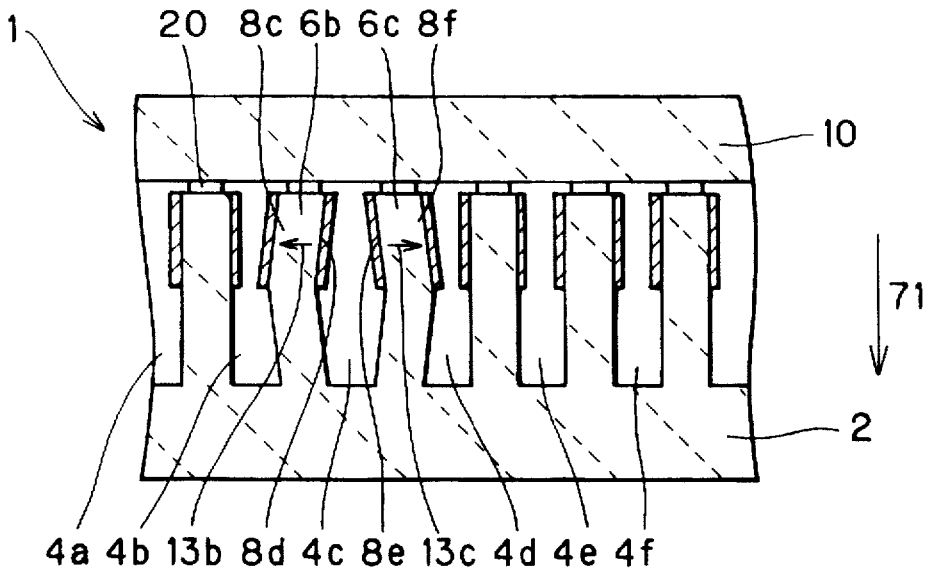
FIG. 4(b) PRIOR ART
Figure 5:
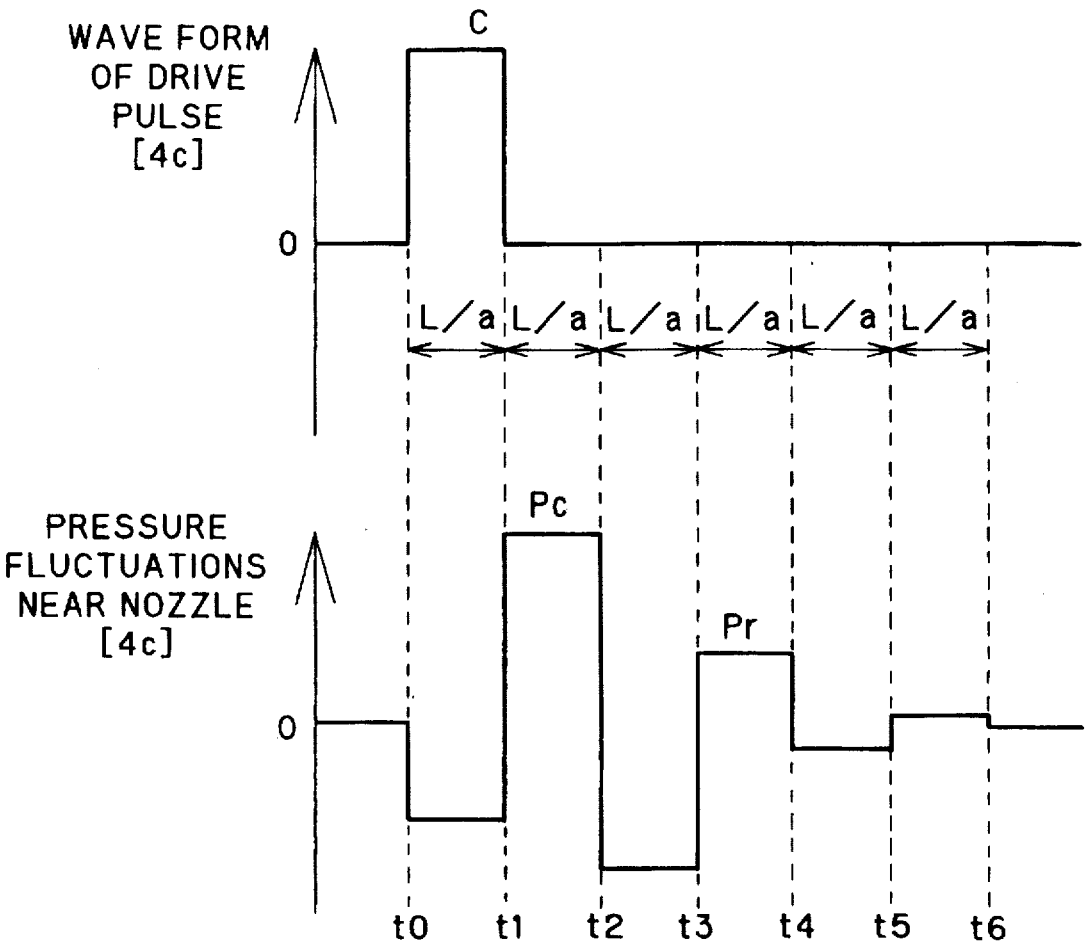
FIG. 5 PRIOR ART
FIG. 5 is a time chart showing waveform of a drive pulse for ejecting ink from an ink chamber of the ink ejection device shown in FIG. 4(*a*), and the resultant pressure fluctuations near the nozzle of the ink chamber.

The ink ejection device according to the preferred embodiment has the same configuration as that shown in FIGS. 1, 4(*a*), and 4(*b*). In this embodiment, the piezoelectric ceramic plate 2 is polarized in the direction indicated by the arrow 71 shown in FIG. 4(*a*).

Figure 7:
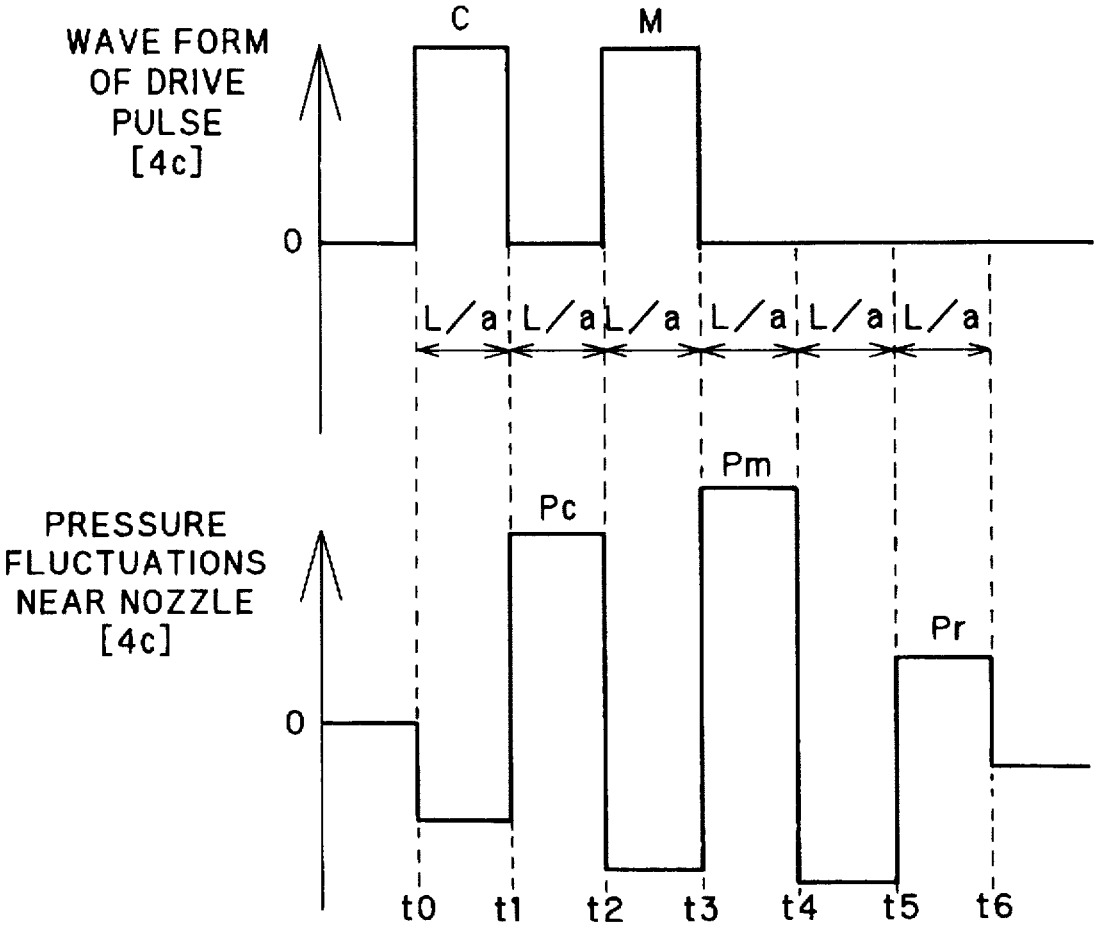
FIG. 7 PRIOR ART
FIG. 7 is a time chart showing a waveform of a multiple drive pulse for ejecting ink and the resultant pressure fluctuations near the nozzle.
Figure 8:
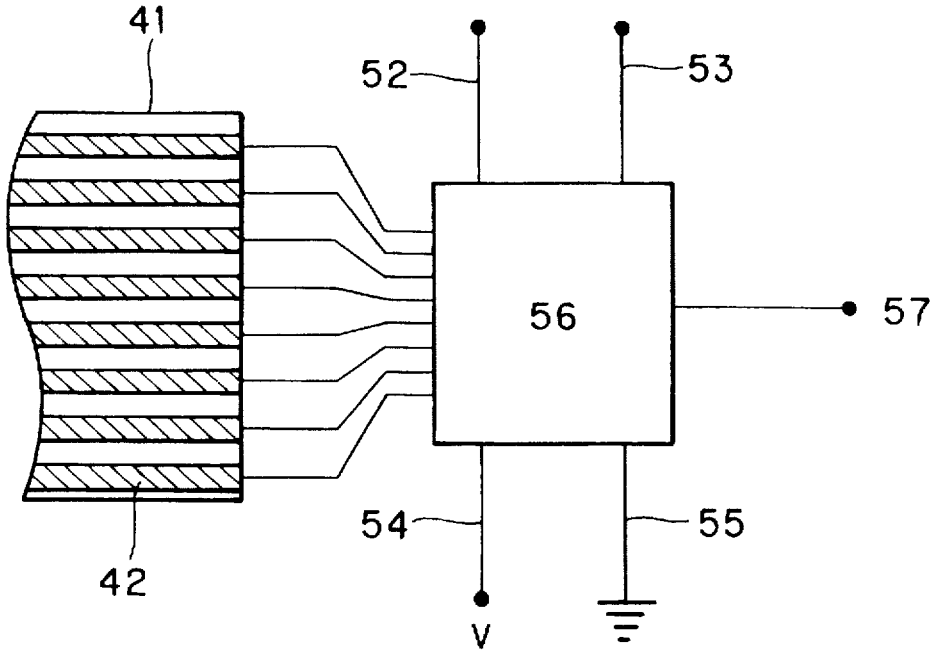
FIG. 8 is a block diagram showing an LSI circuit according to a preferred embodiment of the present invention.

The circuitry according the present embodiment is similar to the conventional circuitry shown in FIG. 7, but as shown in FIG. 8 further includes a pulse width control data line 57, over which information, indicating duration (width) of the drive pulse of voltage for ejecting an ink droplet, is inputted for controlling the pulse width. As shown in FIG. 8, wires of the conductor layer pattern 42 formed in the substrate 41 are individually connected to the LSI chip 56. The clock line 52, the print data line 53, the piezoelectric line 54, the ground line 55, and the pulse width control data line 57 are also connected to the LSI chip 56.

Figure 9:
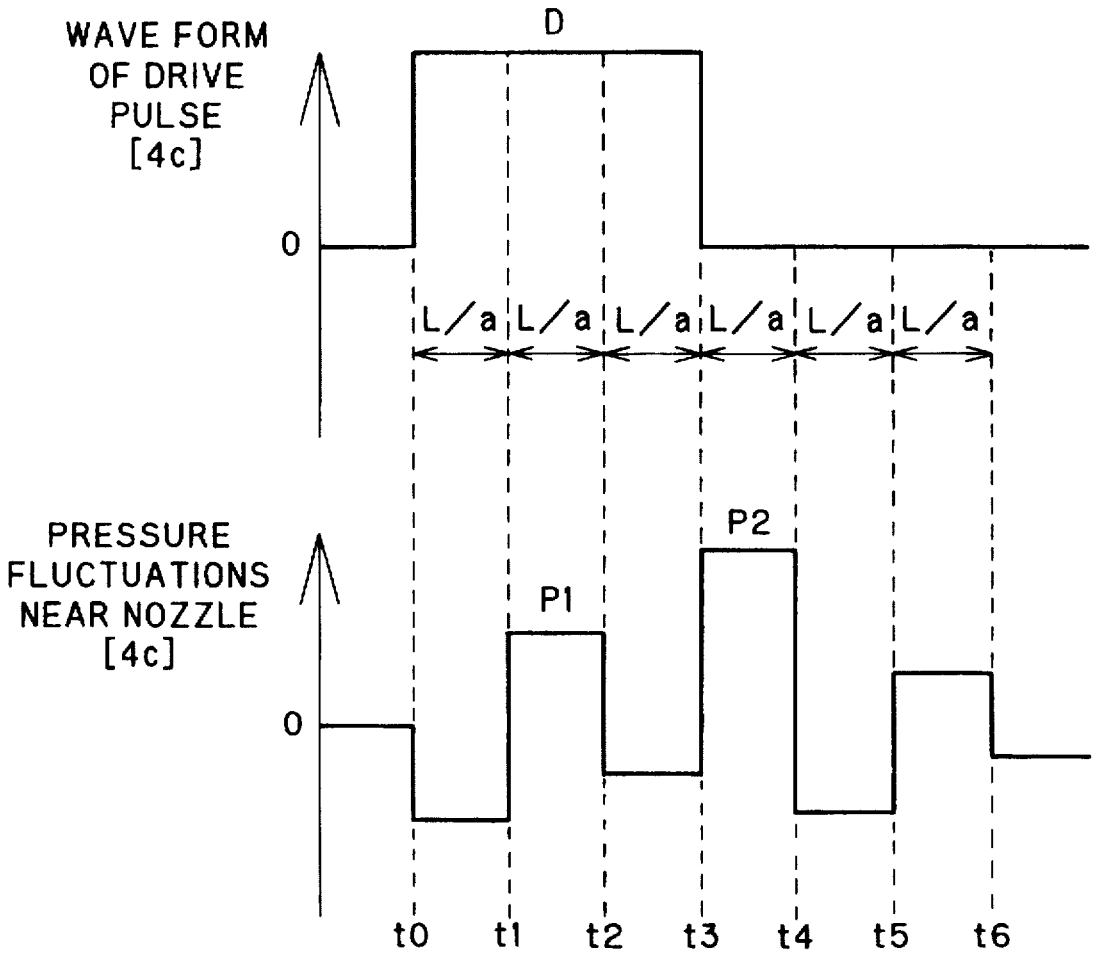
FIG. 9 is a time chart showing a waveform of a drive pulse according to the preferred embodiment for ejecting ink and the resultant pressure fluctuations near the nozzle.

Next, an explanation of operation of the ink ejection device will be provided while referring to FIG. 4(*a*), 4(*b*), and 9. FIG. 9 shows timing of drive waves and of pressure fluctuations near the nozzle in the ink chamber. The LSI chip 56 first determines from which of the nozzles 12 an ink droplet is to be ejected according to print data sent over the print data line 53 and based on the clock pulse continuously supplied over the clock line 52. In this example, an ink droplet is to be ejected from ink chamber 4*c*.

According to information inputted over the pulse width control data line 57, the LSI chip 56 determines the pulse width of voltage to be applied to the ink chamber 4*c*. In this example, the information supplied over the pulse width control data line 57 indicates a pulse width (i.e., duration of the pulse) of three times the time interval L/a (i.e., 3 L/a), wherein L is the length of the ink chamber 4 and a is the speed of sound in the ink filling ink chamber 4*c*. Accordingly, time interval L/a represents the time required for the pressure wave in the ink chamber 4 to propagate across the length of the ink chamber 4, that is, from the manifold 18 to the nozzle plate 14.

The LSI chip 56 applies the drive pulse D with duration of time 3 L/a to the line of the conductor pattern 42 corresponding to the ink chamber 4*c*, thereby energizing the metal electrodes 8*d* and 8*e* of the ink chamber 4*c*. The LSI chip 56 connects the lines of other metal electrodes 8 with the ground line 55. As shown in the upper half of FIG. 9, application of the drive pulse D to the metal electrodes 8*d* and 8*e* begins at the time t0, which corresponds to the rising edge of the waveform. Upon application of the voltage, the walls 6*b* and 6*c* of the ink chamber 4*c* rapidly deform so as to separate from each other as shown in FIG. 4(*b*). The deformation of the walls 6*b* and 6*c* increases the volume of the ink chamber 4*c* from when the walls 6*b* and 6*c* are in their natural condition. The overall pressure in the ink chamber 4*c*, including that near the nozzle 12, decreases so that ink is sucked into the ink chamber 4*c* from the manifold 18. According to theories on pressure propagation, the pressure near the nozzle 12 changes between positive and negative pressures every passage of the time interval L/a, that is required for a pressure wave to propagate from the manifold 18 to the nozzle 12 at the speed of sound in the ink. Therefore, a negative pressure is maintained near the nozzle 12 from the time t0 to the time t1 as shown in the lower half of FIG. 9. While the pressure near the nozzle 12 is negative, the meniscus of ink at the nozzle 12 retracts toward the interior of the ink chamber 4*c*, so that at time point t1, the meniscus appears as shown in FIG. 10(*b*).

Directly after the time point t1, the pressure near the nozzle 12 in the ink chamber 4*c* changes to a positive pressure. The pressure near the nozzle 12 in the ink chamber 4*c* fluctuates in this manner between periods of positive and negative pressures that each last for a time interval L/a. The pressure in the ink chamber 4*c* near the nozzle 12 attenuates as it fluctuates with a cycle of two time the time interval L/a. The rate of pressure attenuation depends on the viscosity of the ink and the shape of the nozzle 12, including the length and size of the nozzle.

Between time points t1 and t2, the pressure near the nozzle 12 is a positive pressure P1, which is maintained for a duration of time equal to the time interval L/a. The positive pressure P1 pushes the meniscus 24 out of the nozzle 12 as shown in FIG. 10(*c*) to produce a preparatory ejection. Preparatory ejections like this either result in no actual ejection of an ink droplet or in ejection of a slowly traveling ink droplet.

Directly after time period t2, pressure near the nozzle 12 again reverts to a negative pressure, which is maintained until time period t3. However, this negative pressure produces very little effect on the protruding meniscus, or slowly moving ink droplet, at the nozzle 12. Therefore the protruding meniscus or the slowing moving ink droplet is not drawn back within the nozzle 12. At most the neck portion 28 of the ink is caused to narrow as shown in FIG. 10(*d*).

At time point t3, when the pressure near the nozzle 12 again reverts to a positive pressure, application of the drive pulse D is discontinued so the lowering edge of the pulse coincides with the time point t3. The walls 6b and 6c revert to their natural condition of before deformation as shown in FIG. 4(*a*). The volume of the ink chamber 4c decreases from the increased volume to the natural volume so that the overall pressure in the ink chamber 4c, including the pressure near the nozzle 12, increases. The pressure increase caused when the walls 6b and 6c deform combines with the existing positive pressure near the nozzle 12 in the ink chamber 4c to form a relatively high pressure P2 near the nozzle 12 as shown in the lower half of FIG. 9. As shown in FIG. 10(*e*), the high pressure P2 pushes more ink from the nozzle 12 that joins with the ink pushed out of the nozzle 12 by pressure P1. This results in an ink droplet 26 with a relatively large volume being ejected from the nozzle 12 of ink chamber 4c as shown in FIGS. 10(*f*) through 10(*h*).

In this example, by setting the width of the drive pulse to the duration of time 3 L/a, an ink droplet is generated with a volume larger than the volume of the ink droplet produced by the conventional method of setting the width of the drive pulse to a duration of time L/a. However, by setting the drive pulse to a duration of time 5 L/a, an ink droplet with volume further increased by an additional preparatory ejection can be ejected. Pulse of increasingly long durations can be used to produce greater volume ink droplets as long as the duration of the voltage application is derived by multiplying the time interval L/a by increasingly large odd numbers to increase the number of preparatory ejections and as long as the phases of pressure fluctuations produced near the nozzle in the ink chamber by rising and lowering edges of the drive pulse coincide. However, because the pressure fluctuations in the ink chamber attenuate with time, increasing the duration of the drive pulse to longer than seven times the time interval L/a will not increase the volume of the ejected droplet. The low positive pressure present in the ink chamber by time point t7 will probably not result in a preparatory ejection or will not combine well with the pressure wave caused when application of voltage is stopped.

Figure 11:
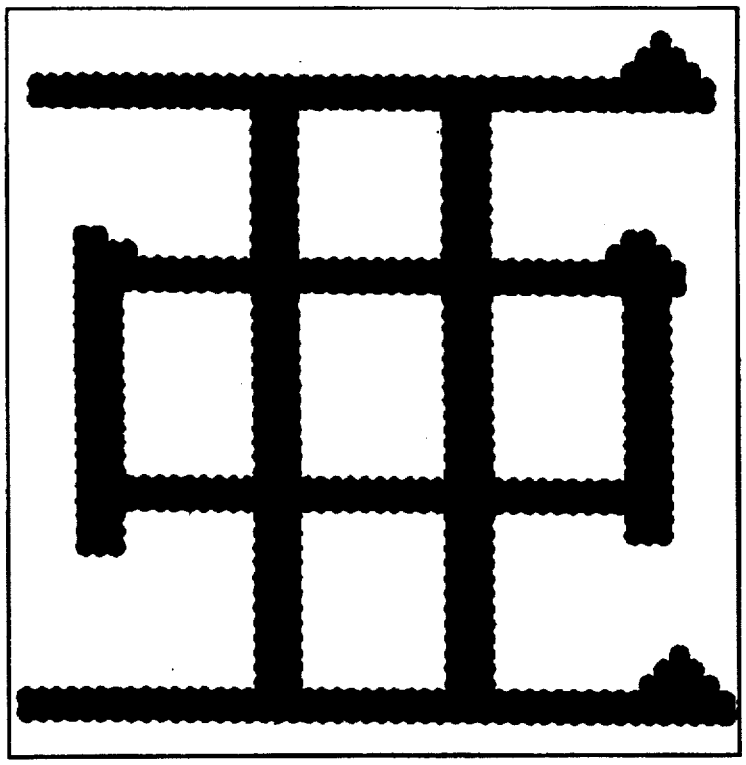
FIG. 11 is a view showing a character printed by the ink ejection device according to the preferred embodiment using drive pulses applied for a predetermined duration of time.
Figure 12:
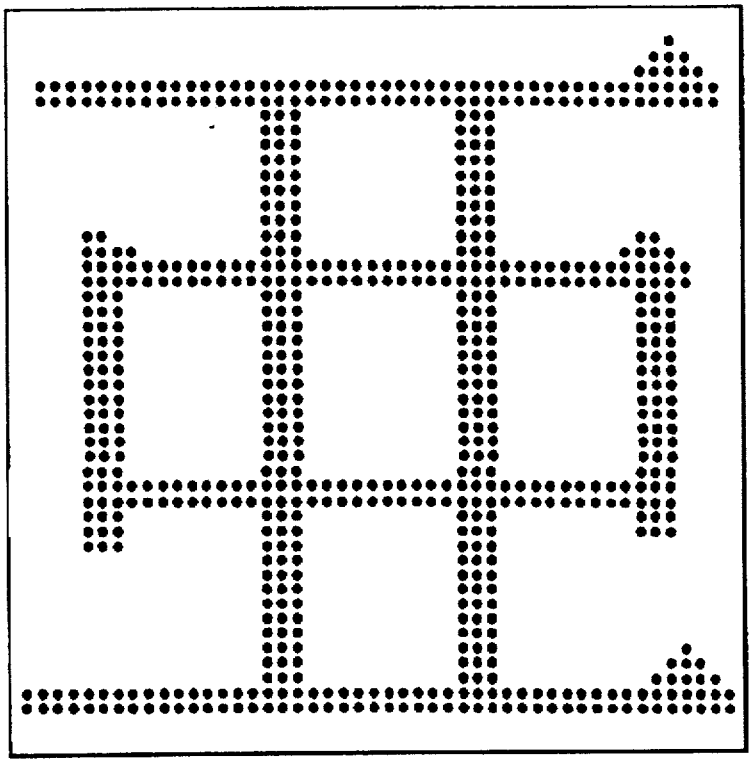
FIG. 12 is a view showing a character printed by the ink ejection device according to the preferred embodiment using drive pulses applied for a different predetermined duration of time.

As explained above, the LSI chip 56 changes the duration of time at which drive voltages are applied, thereby changing the volume of the ejected ink droplet, according to data from the pulse width control data line 57. Therefore, tone of printed characters can be changed by changing command outputted from a host computer. For example, during normal printing operations, the host computer can be programmed to cause voltage to be applied for durations of time 3 L/a. This will generate large volume droplets to produce high-density characters such as the one shown in FIG. 11. On the other hand, when printing first drafts of documents, or during other occasions when appearance of characters is not of major importance, a draft mode can be used to save consumption of ink. During the draft mode, drive pulses are automatically set by commands from the host computer to a duration of time equal to one times the time interval L/a. Ejected droplets will have a lower volume, resulting in characters with a lighter tone, as shown in FIG. 12.

In the present embodiment, the volume of ejected ink droplets is changed by changing duration of applied voltage pulses. The same amount of power is therefore consumed during normal printing and during light tone printing. Since less power is used than during conventional multiple pulse printing, there is no danger of the drive circuitry being damaged by overheating. Measures required for multiple pulse printing, such as producing the drive circuitry from thermally resistant materials or providing heat fins to the drive circuitry, are not necessary so that production costs are lower than with conventional printers. The walls 6 are deformed the same number of times during normal printing as in light tone printing so that the life of the ink ejection device according to the present invention is longer than that of multiple pulse ink ejection devices.

Further, because the propagated pressure wave in the ink chamber 4 is used for pushing a portion of the ink out of the nozzle 12, the drive wave is no more complicated than drive waves used with conventional ink ejection devices. Therefore, no additional drive energy need be applied. Therefore the drive circuit can be made with a simple inexpensive configuration.

The LSI 51 controls application of voltage to ink chambers so that the volume of ink chambers from which ink is to be ejected is in an increased condition for a duration of time required for the pressure wave that is generated when the volume in the ink chamber increases to travel the length of the ink chamber an odd number of times. As a result, the number of times the pressure wave pushes ink from the ejection nozzle, without ejecting it, can be changed so that the volume of the ejected ink droplet can be controlled. This allows printing different tones of characters. Ink can be conserved by printing the lightest tone of character. Less power is consumed than is consumed by multiple pulse type ink ejection devices because the volume of the ink droplet can be changed without application of additional pulses of voltage. Therefore, an ink droplet with desired volume can be obtained with a relatively small amount of voltage. Also, because less power is used, less heat is generated so that heat related damage is prevented.

The volume of ejected droplets can be increased without increasing the number of times the volume in the ink chamber is changed, resulting in a longer life of the ink ejection device. Further, because ink is pushed from the nozzle using the pressure wave propagated in the ink chamber, the waveform of the drive pulse retains a simple shape. Therefore, no additional energy need be applied to eject larger volume droplets so that a simple and inexpensive drive circuit can be used. Running costs are also low.

While the invention has been described in detail with reference to specific embodiments thereof, it would be apparent to those skilled in the art that various changes and modifications may be made therein without departing from the spirit of the invention, the scope of which is defined by the attached claims.

For example, although in the present embodiment adjacent ink chambers 4 in the ink ejection device are capable of ejecting ink, non-ejecting air chambers could be provided between ink ejecting ink chambers. In this case, electrodes in the ink ejecting ink chambers could be connected to ground while electrodes in the air chambers are connected to the voltage source. Further, although ink is ejected in the present embodiment by deformation of both walls that form an ink chamber 4, ink could be ejected by deformation of only one of two walls.

In the present embodiment, metal electrodes 8 are formed to the upper half region of the piezoelectric material walls 6, and the volume of the ink chambers 4 changed by deformation of the lower half of the walls 6 by the piezoelectric effect at the upper half. However, walls could be made from two oppositely polarized piezoelectric ceramic pieces and an electrode formed to entire surface of the wall, so that volume of the ink chamber is changed by piezoelectric shear deformation in the thickness direction equally at upper and lower halves of the wall. Further, the upper or lower half of the walls could be formed from a piezoelectric ceramic, and the other half formed from an insulation material. Then an electrode could be formed on the entire surface of the wall.

Although the ink channels 4 are formed by forming the grooves 3 on one side of the piezoelectric ceramic plate 2, grooves could be formed on both sides of a thicker piezoelectric ceramic plate so that ink chambers could be provided to both sides of the piezoelectric ceramic plate.

In the present embodiment, the volume of the ink chamber 4 is increased from the natural volume when the walls are in their natural condition to an increased volume when the walls are deformed. Ink is ejected by afterward returning the volume of the ink chamber 4 to the natural volume. However, after increasing the volume of the ink chamber 4 by deforming the wall, ink could be ejected by reducing the volume in the ink chamber to a volume that is less than the natural volume. This could be done by deforming the walls in the direction opposite to the direction they were deformed to increase the volume of the ink chamber.

The present invention was described in the preferred embodiment applied to a shear mode type ink ejection device. However, the present invention could be applied to a Kaiser or other direct mode type ink ejection device.

The waveform of the drive pulse was rectangular according to the present embodiment. However, the rising edge, the lowering edge, or both edges of the waveform could be slanted.

In the present embodiment, the volume in the ink chambers is changed in a desired manner by deforming the piezoelectric elements that form the walls of the ink chamber by applying a voltage to the metal electrodes formed on the walls. However, the piezoelectric elements could be formed so that stopping application of the voltage provides the desired deformation required for changing the volume in the ink chamber.

The present invention can also be applied to an ink ejection device for color printing.

What is claimed is:

1. An ink ejection device for ejecting ink droplets from a nozzle, the ink ejection device comprising:

an ink chamber, the ink chamber having a length and an initial volume, the ink chamber being filled with ink;

ink chamber volume changing means for increasing a volume of the chamber from the initial volume to an increased volume, a pressure wave being generated in the ink that propagates through the ink at a velocity of one length of the ink chamber over a time interval, and for decreasing the volume of the ink chamber from the increased volume; and control means for controlling said ink chamber volume changing means to increase the volume of the ink chamber to at least protrude an amount of ink from the nozzle and, upon completion of a predetermined duration of time defined as approximately the time interval multiplied by an odd number at least equal to three, to decrease the volume of the ink chamber to eject the amount of ink along with an additional amount of ink.

2. An ink ejection device as claimed in claim 1 wherein said control means is further capable of controlling said ink chamber volume changing means to decrease the volume of the ink chamber upon completion of a different predetermined duration of time after said ink chamber volume changing means increases the volume of the chamber, the different predetermined duration of time being defined as approximately the time interval multiplied by a different odd number.

3. An ink ejection device as claimed in claim 2 wherein said control means is provided with a normal printing mode and a draft mode, said control means causing said ink chamber volume changing means to decrease the volume of the ink chamber at a time that corresponds to a longer one of the predetermined duration of time and the different predetermined duration of time when in the normal printing mode and at a time that corresponds to a shorter one of the predetermined duration of time and the different predetermined duration of time when in the draft mode, such that larger ink droplets are ejected in the normal printing mode than in the draft mode.

4. An ink ejection device as claimed in claim 3 wherein both the predetermined duration of time and the different predetermined duration of time are less than seven times the time interval.

5. An ink ejection device as claimed in claim 4 wherein:

said ink chamber includes an ink chamber wall defining at least a portion of the ink chamber;

said ink chamber volume changing means includes a polarized piezoelectric element that forms at least a portion of the ink chamber wall, and an electrode formed on the piezoelectric element; and said control means increases the volume of the ink chamber by applying a voltage to the electrode and decreases the volume of the ink chamber by stopping application of the voltage to the electrode.

6. An ink ejection device as claimed in claim 5 wherein the piezoelectric element is polarized in a direction perpendicular to an electric field formed by application of the voltage to the electrode.

7. An ink ejection device as claimed in claim 1 wherein:

said ink chamber volume changing means includes a polarized piezoelectric element, which forms at least a portion of the ink chamber wall, and an electrode formed on the piezoelectric element; and said control means increases the volume of the ink chamber by applying a voltage to the electrode and decreases the volume of the ink chamber by stopping application of the voltage to the electrode.

8. An ink ejection device as claimed in claim 7 wherein the piezoelectric element is polarized in a direction perpendicular to an electric field formed by application of the voltage to the electrode.

9. An ink ejection device as claimed in claim 1 wherein the predetermined duration of time is less than seven times the time interval.

10. A method for driving an ink ejection device for ejecting ink droplets from a nozzle, the method comprising the steps of:

increasing a volume of an ink chamber from an initial volume to an increased volume so that a pressure wave is generated in ink filling the ink chamber and an amount of ink is protruded from the nozzle, the pressure wave propagating through the ink at a velocity of one length of the ink chamber over a time interval; and decreasing the volume of the ink chamber from the increased volume to eject the amount of ink along with an additional amount of ink upon completion of a predetermined duration of time defined as approximately the time interval multiplied by an odd number at least equal to three.

11. A method as claimed in claim 10 wherein the predetermined duration of time is less than seven times the time interval.

12. A method as claimed in claim 11 wherein:

the step of increasing the volume of the ink chamber is performed by applying a voltage to an electrode formed on a piezoelectric element which forms at least a portion of a wall of the ink chamber wall; and the step of decreasing the volume of the ink chamber is performed by stopping application of the voltage to the electrode.

13. A method as claimed in claim 12 wherein the step of increasing the volume of the ink chamber is performed by causing the piezoelectric element to deform in a shear mode by applying the voltage to the electrode, an electric field in a direction perpendicular to direction of polarization of the piezoelectric element.

14. A method as claimed in claim 10 wherein:

the step of increasing the volume of the ink chamber is performed by applying the voltage to an electrode formed on a piezoelectric element which forms at least a portion of a wall of the ink chamber wall; and the step of decreasing the volume of the ink chamber is performed by stopping application of the voltage to the electrode.

15. A method as claimed in claim 14 wherein the step of increasing the volume of the ink chamber is performed by causing the piezoelectric element to deform in a shear mode by applying the voltage to the electrode, an electric field being generated in a direction perpendicular to a direction of polarization of the piezoelectric element.

16. A method as claimed in claim 15 wherein the step of decreasing the volume of the ink chamber is performed after a time period that is greater than the time interval elapses after the step of increasing the volume of the ink chamber is performed and while a meniscus of ink at the nozzle is being pushed outward from the ink chamber.

17. A method as claimed in claim 10 wherein the step of decreasing the volume of the ink chamber is performed after a time period, that is greater than the time interval, elapses after the step of increasing the volume of the ink chamber is performed and while a meniscus of ink at the nozzle is being pushed outward from the ink chamber.

18. An ink ejection device for ejecting ink droplets from a nozzle, the ink ejection device comprising:

a polarized piezoelectric element having an initial shape and forming at least a portion of a wall of an ink chamber, the chamber having a length and an initial volume and connected with a nozzle and filled with ink;

an electrode formed on said piezoelectric element; and an LSI chip applying a voltage to the electrode to deform said piezoelectric element so that a volume of the ink chamber increases from the initial volume to at least protrude an amount of ink from the nozzle, a pressure wave being generated in the ink and propagating through the ink at a velocity of one length of the ink chamber over a time interval and, upon completion of a predetermined duration of time defined as approximately the time interval multiplied by an odd number at least equal to three, stopping an application of the voltage to said electrode to return said piezoelectric element to the initial shape to eject the amount of ink along with an additional amount of ink.

19. An ink ejection device as claimed in claim 18 further comprising a control unit electrically connected to the LSI chip, the LSI chip switching the ink ejection device between a first printing mode, during which said LSI chip stops application of the voltage to the electrode at a time that corresponds to a longer one of the predetermined duration of time and a different predetermined duration of time, the different predetermined duration of time being defined as approximately the time interval multiplied by a different odd number, and a second printing mode, during which said LSI chip stops application of the voltage to the electrode at a time that corresponds to a shorter one of the predetermined duration of time and the different predetermined duration of time, such that larger ink droplets are ejected in the normal printing mode than in the draft mode.

20. An ink ejection device as claimed in claim 19 wherein both the predetermined duration of time and the different predetermined duration of time are less than seven times the time interval.

21. An ink ejection device as claimed in claim 19 wherein the piezoelectric element is polarized in a direction perpendicular to an electric field formed by application of the voltage to the electrode.

22. An ink ejection device as claimed in claim 1, wherein the time interval is L/a, wherein L is the length of the ink chamber and a is the speed of sound through the ink chamber.

23. A method as claimed in claim 10, wherein the time interval is L/a, wherein L is the length of the ink chamber and a is the speed of sound through the ink chamber.

24. An ink ejection device as claimed in claim 18, wherein the time interval is L/a, wherein L is the length of the ink chamber and a is the speed of sound through the ink chamber.

* * * * *